US006829462B2

(12) United States Patent
Nagashiro

(10) Patent No.: US 6,829,462 B2
(45) Date of Patent: Dec. 7, 2004

(54) TONER SUPPLY APPARATUS FOR IMAGE FORMING MACHINE

(75) Inventor: Keiichi Nagashiro, Mie (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 10/346,466

(22) Filed: Jan. 17, 2003

(65) Prior Publication Data

US 2003/0138272 A1 Jul. 24, 2003

(30) Foreign Application Priority Data

Jan. 23, 2002 (JP) ..... 2002-014488

(51) Int. Cl.[7] ..... G03G 15/08
(52) U.S. Cl. ..... 399/258; 399/262
(58) Field of Search ..... 399/258, 262

(56) References Cited

U.S. PATENT DOCUMENTS 5,229,824 A 7/1993 Tsusaka et al.
5,610,692 A * 3/1997 Trask et al. ..... 399/27
5,659,837 A 8/1997 Jo
6,014,536 A * 1/2000 Ban et al. ..... 399/258
6,289,193 B1 * 9/2001 Ban et al. ..... 399/258

FOREIGN PATENT DOCUMENTS

EP 0 248 682 A3 9/1987
EP 0 248 682 A2 9/1987

* cited by examiner

*Primary Examiner*—Quana Grainger
(74) *Attorney, Agent, or Firm*—Schuite Roth & Zabel LLP; Joel E. Lutzker; John C. Garces

(57) ABSTRACT

A toner supply container comprises a container body accommodating toner. The container body is detachably mounted from above into a machine body of an image forming machine along a first guide member and a second guide member provided with a predetermined spacing in the machine body. The toner supply container includes a first locking mechanism disposed in one end portion of the container body, and a second locking mechanism disposed in the other end portion of the container body. The first locking mechanism includes an engagement claw to be engaged with an engagement stop portion provided in the first guide member when the container body is located at a mounting position, and an unlocking lever for releasing engagement between the engagement claw and the engagement stop portion. The second locking mechanism includes engagement claws which engage engagement stop portions provided in the second guide member when the container body is located at the mounting position, and whose engagement with the engagement stop portions is released when the one end portion of the container body is brought upward to tilt the container body.

7 Claims, 8 Drawing Sheets

TONER SUPPLY APPARATUS FOR IMAGE FORMING MACHINE

FIELD OF THE INVENTION

This invention relates to a toner supply container for supplying a toner to a developing device of an image forming machine, such as a printer, a copier, or a facsimile.

DESCRIPTION OF THE PRIOR ART

In an image forming machine utilizing an electrostatic latent image, such as a printer, a copier, or a facsimile, an electrostatic latent image is formed on a photoconductor. The electrostatic latent image is converted to a toner image by a toner developing device. Then, the toner image is transferred to recording paper, and fixed there, to obtain desired recorded matter. When the toner is used in this manner and the toner within the developing device is consumed, the developing device needs to be replenished with toner.

The manner of supplying toner for replenishment comes in a so-called one-time supply method in which the total amount of toner is supplied, at one time, to a toner acceptance container disposed in the body of an image forming machine, and a so-called stationary method in which a toner supply container is mounted in the body of an image forming machine, and then held there in a stationary state so that toner is gradually supplied to a developing device until the toner is used up. In recent years, the stationary method has tended to be adopted as the way of toner supply in order to ensuring compactness of the image forming machine.

The toner supply container for use in the stationary method requires a locking mechanism for its detachable mounting in the body of the image forming machine. For reliable locking of the toner supply container mounted in the body of the image forming machine, it is desirable for the toner supply container to have locking mechanisms at both ends. However, if the locking mechanisms provided at both ends are large, it is difficult to construct the image forming machine in a compact configuration. A color image forming machine, in particular, needs toners of four colors, and the locking mechanisms for the four toner supply containers, if large, pose difficulty in making the image forming machine compact. Provision of the locking mechanisms at both ends also requires that two unlocking mechanisms be operated when the toner supply container is to be detached. Because of these requirements, the stationary type toner supply container is not entirely satisfactory in operability.

SUMMARY OF THE INVENTION

The object of the present invention is to provide a toner supply container of an image forming machine which is equipped with locking mechanisms capable of locking the toner supply container reliably at a mounting position and constructible compactly.

According to the present invention for attaining the above object, there is provided a toner supply container of an image forming machine, comprising a container body accommodating toner, the container body being detachably mounted from above into a machine body of the image forming machine along a first guide member and a second guide member provided with a predetermined spacing in the machine body, the toner supply container including:

a first locking mechanism disposed in one end portion of the container body; and a second locking mechanism disposed in other end portion of the container body, and wherein the first locking mechanism includes an engagement claw to be engaged with an engagement stop portion provided in the first guide member when the container body is located at a mounting position, and an unlocking lever for releasing engagement between the engagement claw and the engagement stop portion, and the second locking mechanism includes engagement claws which engage engagement stop portions provided in the second guide member when the container body is located at the mounting position, and whose engagement with the engagement stop portions is released when the one end portion of the container body is brought upward to tilt the container body.

The second guide member may have a guide groove formed in an up-down direction, and a fitting groove formed so as to be continuous with a lower end of the guide groove, the second locking mechanism may have a guided portion provided on a lower side of the engagement claws and slidable along the guide groove, and the guided portion and the engagement claws may be fitted into the fitting groove.

The second locking mechanism desirably has a fulcrum member disposed above the engagement claws and having a larger amount of protrusion than the amount of protrusion of the engagement claws.

DETAILED DESCRIPTION OF THE PREFERRED EMBODIMENTS

Preferred embodiments of a toner supply container of an image forming machine constituted in accordance with the present invention will now be described with reference to the accompanying drawings.

Figure 1:
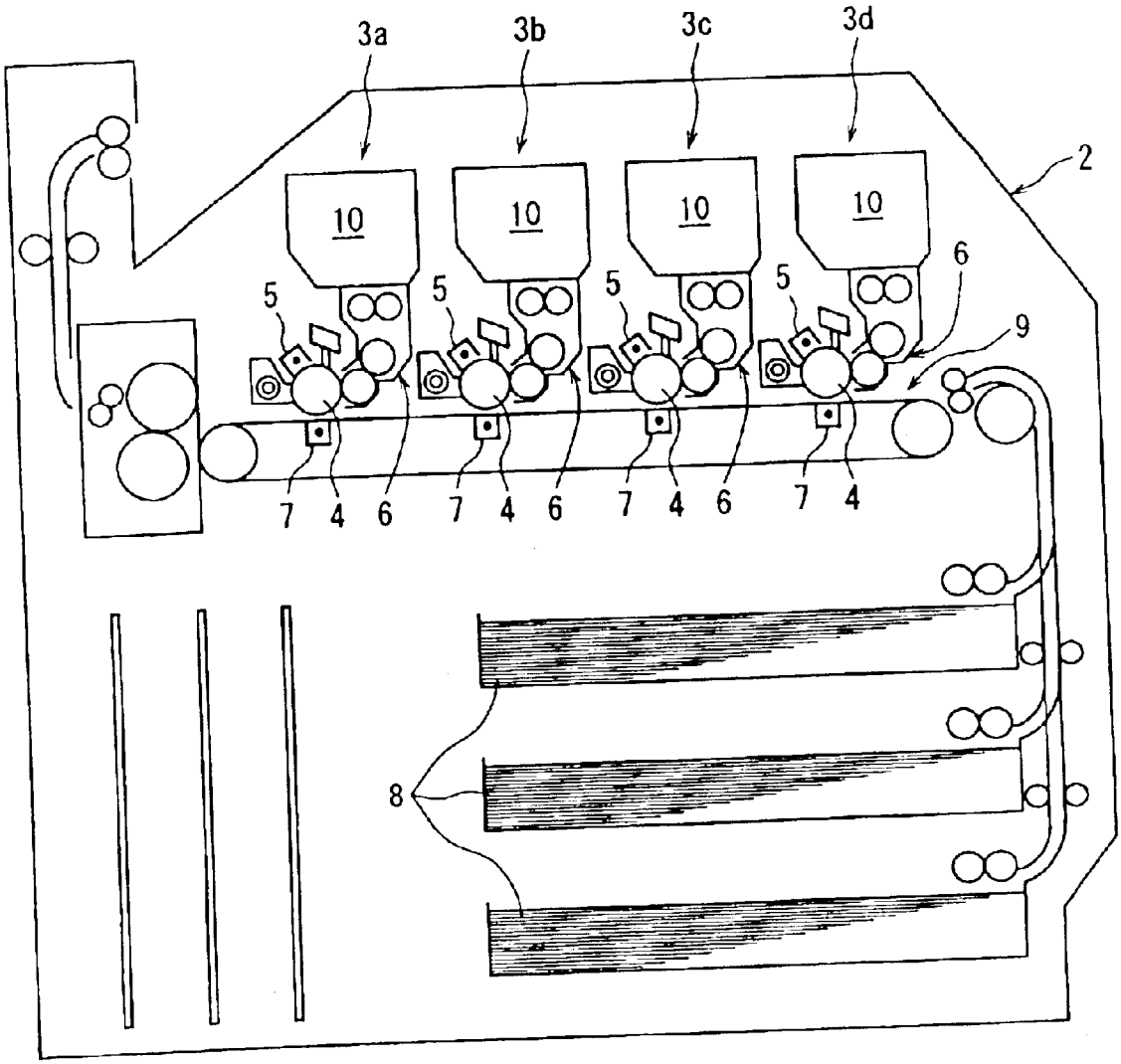
FIG. 1 is a schematic construction drawing showing an embodiment of an image forming machine in which toner supply containers constructed in accordance with the present invention are mounted.

FIG. 1 shows a schematic sectional construction drawing of a tandem type image forming machine equipped with toner supply containers constructed in accordance with the present invention.

The illustrated tandem type image forming machine has a rectangular parallelopipedal housing 2 formed from a plastic material. Within the housing 2, a black process unit 3*a*, a cyan process unit 3*b*, a magenta process unit 3*c*, and a yellow process unit 3*d* are disposed in a right-left direction in the drawing. These process units 3*a*, 3*b*, 3*c* and 3*d* each include a photoconductor drum 4, a charger 5, and a developing device 6. The developing devices 6 of the respective process units are mounted with toner supply containers 10 for supplying toners of the corresponding colors. Below each of the process units, a transfer device 7 is disposed, and a transport belt mechanism 9 is disposed for transporting recording sheets, fed from feed cassettes 8, through a clearance between the photoconductor drum 4 of each process unit and the transfer device 7. The tandem type image forming machine itself may be of a well known construction, and has no direct relation to the present invention. Thus, its further explanation is omitted.

The toner supply container 10 for supplying toner to the developing device 6 will be described with reference to FIGS. 2 to 11.

Figure 2:
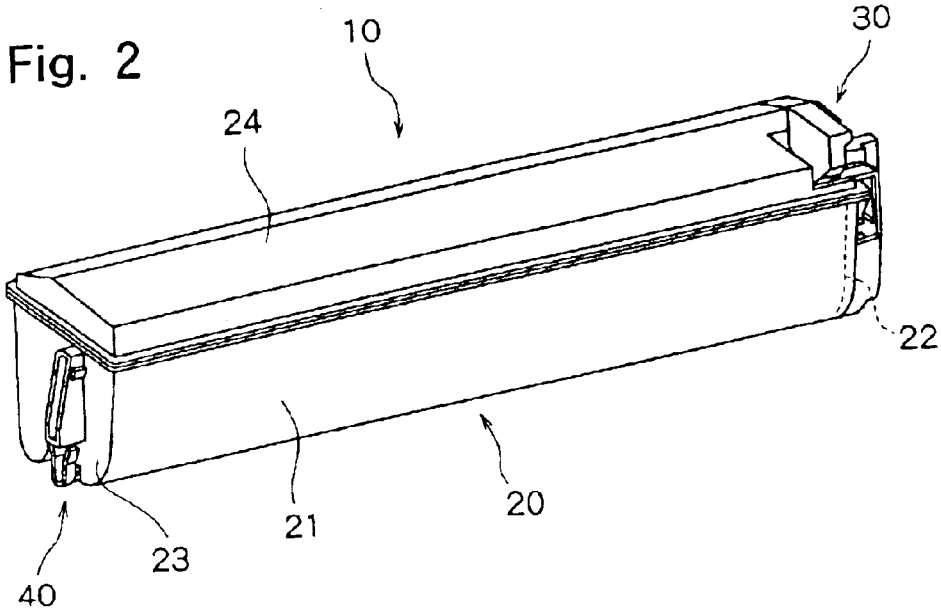
FIG. 2 is a perspective view of the toner supply container constructed in accordance with the present invention.

FIG. 2 shows a perspective view of the toner supply container 10 constructed in accordance with the present invention. The toner supply container 10 in the illustrated embodiment comprises a container body 20 accommodating toner, a first locking mechanism 30 disposed in one end portion of the container body 20, and a second locking mechanism 40 disposed in the other end portion of the container body 20. The container body 20 is constituted by a body 21 of a U-shaped section, an end wall 22 closing one end of the body 21, an end wall 23 closing the other end of the body 21, and a cover 24 closing the upper surface of the body 21. The respective members constituting the container body 20 are formed of a suitable plastic material. A toner delivery opening (not shown) is formed in one end portion of a bottom wall of the U-shaped body 21. The toner delivery opening remains sealed with a removable sealing material (shutter mechanism; not shown) until the toner supply container 10 is mounted. In the so constructed container body 20, a toner agitation/transport mechanism (not shown) is disposed for transporting the accommodated toner toward the toner delivery opening while agitating it. In the embodiment, sealing of the toner delivery opening with a sealing tape has been described. However, there may be adopted a construction in which an opening of a mounting portion of the machine body and the toner delivery opening are provided with covers opening and closing in a manner interlocked with the mounting and withdrawal of the toner supply container 10. This construction may be any construction which enables these openings to be reliably uncovered when the toner supply container 10 is mounted, and to be reliably closed when the toner supply container 10 is withdrawn.

Figure 3:
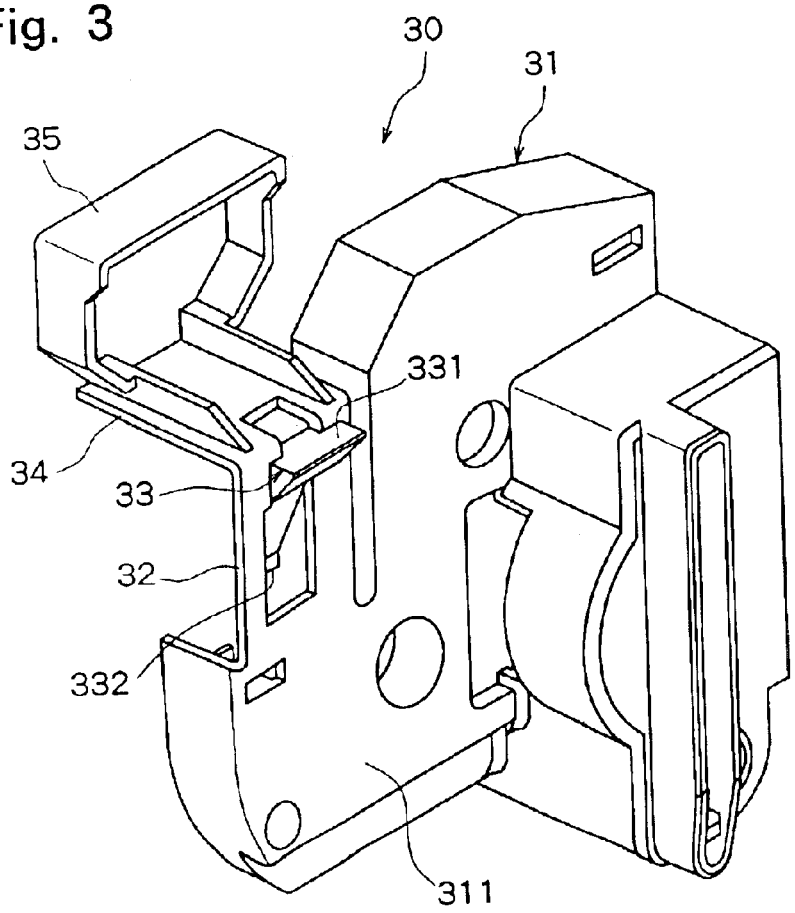
FIG. 3 is a perspective view of a first locking mechanism constituting the toner supply container shown in FIG. 2.
Figure 4:
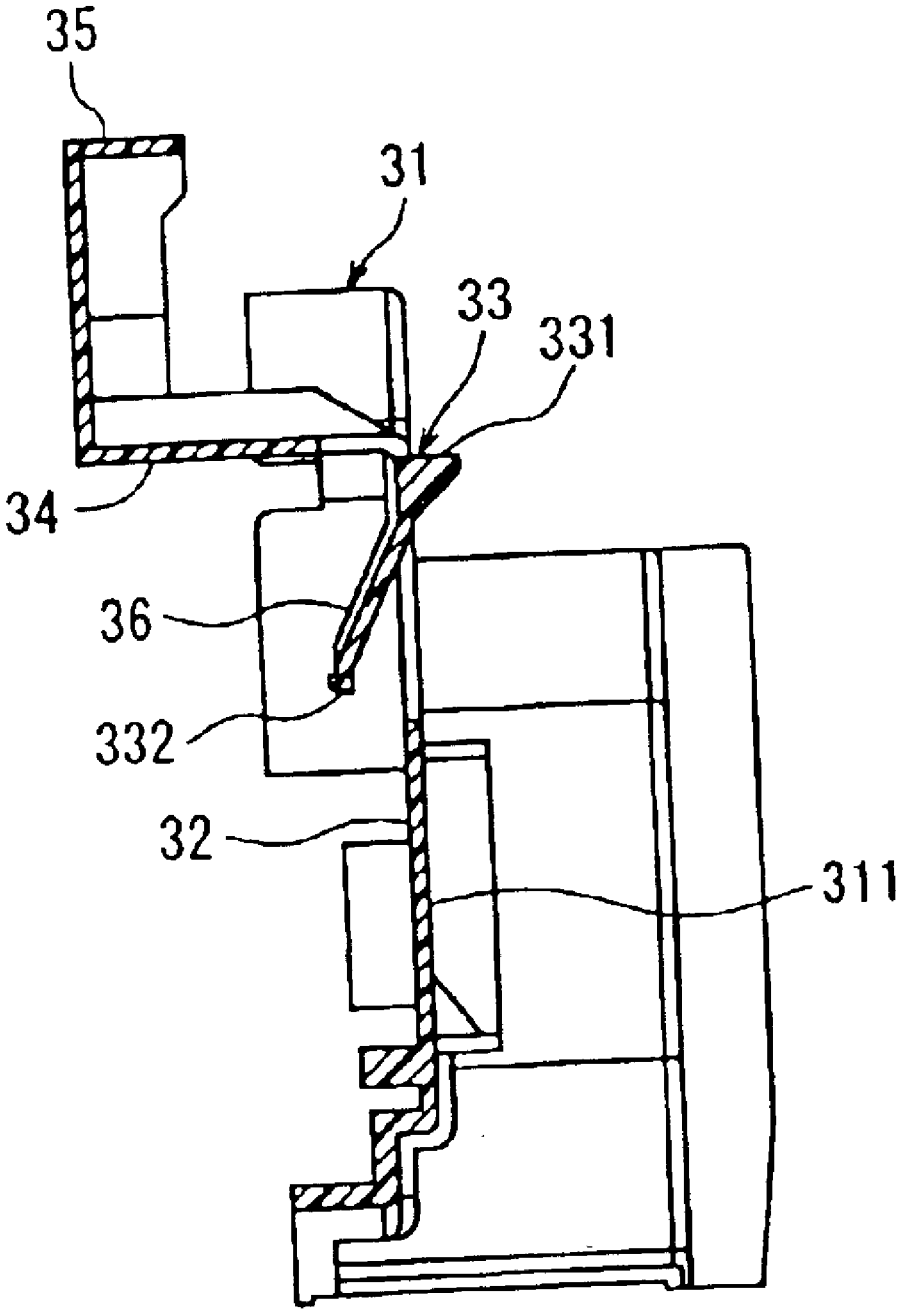
FIG. 4 is a sectional view of the first locking mechanism constituting the toner supply container shown in FIG. 2.

Next, the first locking mechanism 30 disposed in the one end portion of the container body 20 will be described with reference to FIGS. 3 and 4.

The first locking mechanism 30 in the illustrated embodiment is mounted on a side of the end wall 22 closing the one end of the body 21 constituting the container body 20. The illustrated first locking mechanism 30 includes a mounting portion 31 fitted to the one end portion of the body 21 constituting the container body 20, a support leg 32 connected at a lower end to the mounting portion 31 and extending upwardly, an engagement claw 33 provided so as to protrude laterally of an upper end portion of the support leg 32, and an unlocking lever 34 provided horizontally at an upper end of the support leg 32 in a direction opposite to the engagement claw 33. These members are integrally molded from a plastic material. An outer side surface of the mounting portion 31 functions as a guided surface 311. The support leg 32 is adapted to elastically deform about its lower end junction as a fulcrum. The engagement claw 33 has an upper surface 331 formed horizontally, and a lower surface 332 formed so as to incline downwardly from the front end toward the base of the engagement claw 33. At a front end portion of the unlocking lever 34, a grip 35 is integrally molded. In the illustrated embodiment, a spring portion 36 formed so as to protrude obliquely downwardly toward the unlocking lever 34 is provided at the upper end of the support leg 32.

Figure 5:
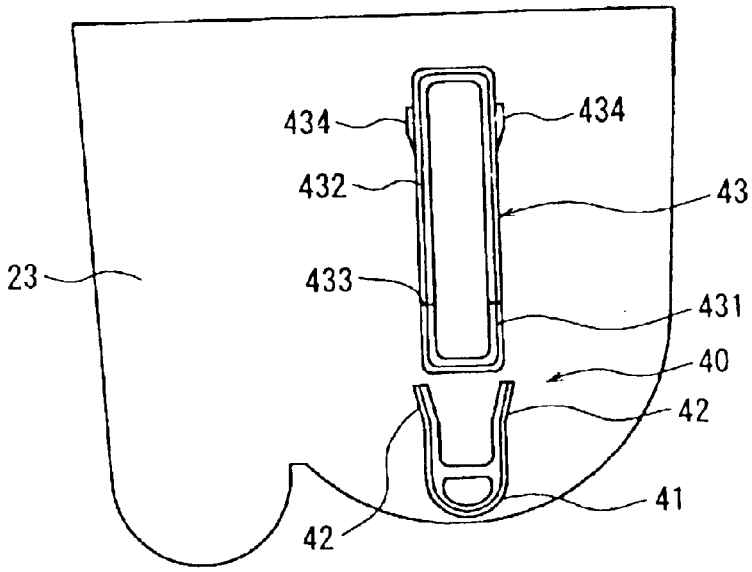
FIG. 5 is a front view of a second locking mechanism constituting the toner supply container shown in FIG. 2.
Figure 6:
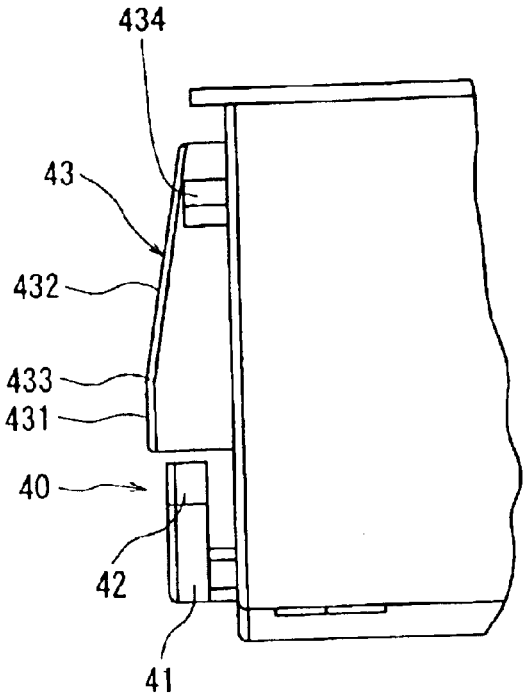
FIG. 6 is a side view of the second locking mechanism constituting the toner supply container shown in FIG. 2.

The second locking mechanism 40 disposed in the other end portion of the container body 20 will be described with reference to FIGS. 5 and 6.

The second locking mechanism 40 in the illustrated embodiment is provided in a laterally protruding manner at a lower portion of a side surface of the end wall 23 closing the other end of the body 21 constituting the container body 20, and is molded from a plastic material integrally with the end wall 23. The illustrated second locking mechanism 40 comprises a guided portion 41 having a lower end portion formed in a semicircular shape, and a pair of engagement claws 42, 42 extending upwardly from both sides of the upper end of the guided portion 41 in a fanning manner. In the so constructed second locking mechanism 40, as shown in FIG. 6, the guided portion 41 is connected to the end wall 23, and the pair of engagement claws 42, 42 are separated from the end wall 23. Thus, the pair of engagement claws 42, 42 can elastically deform about the site of connection to the guided portion 41 as a fulcrum.

Figure 7:
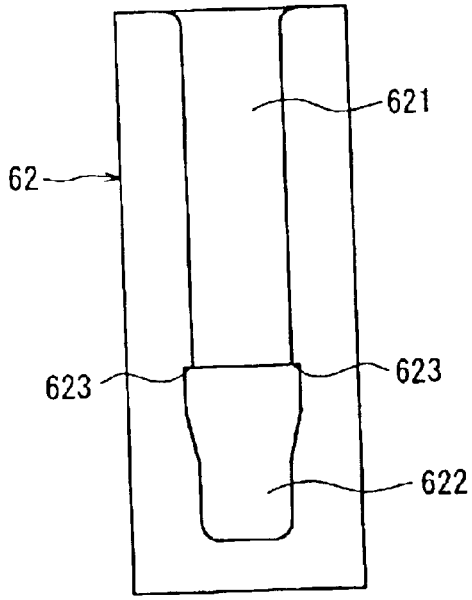
FIG. 7 is a front view of a second guide member for guiding the second locking mechanism constituting the toner supply container shown in FIG. 2.

The dimensional relationship between the guided portion 41 and the pair of engagement claws 42, 42, which constitute the second locking mechanism 40, will be described. FIG. 7 shows a second guide member 62 provided in a housing 60 (see FIGS. 10 and 11) of the developing device 6. The second guide member 62 is provided with a guide groove 621 formed in an up-down direction, and a fitting groove 622 formed so as to be continuous with the lower end of the guide groove 621. The diameter, i.e., widthwise dimension, of the guided portion 41 constituting the second locking mechanism 40 is slightly smaller than the widthwise dimension of the guide groove 621, so that the guided portion 41 is slidable in the guide groove 621. The dimension between the outer edges of the upper ends of the pair of engagement claws 42, 42 constituting the second locking mechanism 40 is greater than the widthwise dimension of the guide groove 621. The fitting groove 622 formed so as to be continuous with the lower end of the guide groove 621 is formed in such a size that the guided portion 41 and the pair of engagement claws 42, 42 are fitted therein.

The second locking mechanism 40 in the illustrated embodiment also has a guide/fulcrum member 43 provided above the pair of engagement claws 42 and 42 so as to protrude laterally of the side surface of the end wall 23. The widthwise dimension of the guide/fulcrum member 43 is substantially the same as the widthwise dimension of the guided portion 41. The amount of protrusion of the guide/fulcrum member 43 from the side surface of the end wall 23 is set such that the upper end of the guide/fulcrum member 43 is of a dimension smaller than the amount of protrusion of the guided portion 41 and the pair of engagement claws 42, 42, and that a lower end portion 431 thereof serving as a fulcrum site is of a dimension larger than the amount of protrusion of the guided portion 41 and the pair of engagement claws 42, 42. The upper end of the guide/fulcrum member 43 and the upper end of the lower end portion 431 are formed so as to be continuous via an inclined surface 432. A junction 433 between the inclined surface 432 and the lower end portion 431 functions as the fulcrum site as will be described later. On both side surfaces of an upper end portion of the guide/fulcrum member 43, backlash preventing portions 434, 434 are formed in a protruding manner. The dimension between the outer edges of the backlash preventing portions 434, 434 corresponds to the widthwise dimension of the guide groove 621.

The toner supply container 10 in the illustrated embodiment is constructed as described above. Its mounting to and withdrawal from the machine body of the image forming machine will be described with reference to FIGS. 8 to 11. In the illustrated embodiment, the mounting portion of the machine body, where the toner supply container 10 is to be mounted, is provided in the housing 60 of the developing device 6.

To mount the toner supply container 10 in the housing 60 of the developing device 6, the toner supply container 10 is lowered along a first guide member 61 and the second guide member 62 extending upwardly at the opposite ends of the housing 60. At this time, the guided surface 311 formed in the mounting portion 31 of the first locking mechanism 30 mounted on the one end portion of the body 21 constituting the container body 20 is lowered along the first guide member 61. At the same time, the guided portion 41 and the pair of engagement claws 42, 42 provided on the end wall 23 closing the other end of the body 21 constituting the container body 20 are caused to descend while fitting into the guide groove 621 of the second guide member 62.

During the descent of the toner supply container 10, the engagement claw 33 constituting the first locking mechanism 30 makes a sliding contact with a guide surface 611 of the first guide member 61. Thus, the support leg 32 elastically deforms toward the container body 20, with its lower end junction serving as the fulcrum. When the toner supply container 10 arrives at the mounting position shown in FIG. 9, the engagement claw 33 engages an engagement stop hole 612 formed in the first guide member 61, with the result that the toner supply container 10 is restrained from moving upward and brought into a locked state. At this time, a lower end portion of the spring portion 36 contacts a contact portion 221 provided on the end wall 22. As a result, the spring portion 36 elastically deforms with its upper end as a fulcrum. Its spring force presses the support leg 32 toward the first guide member 61, namely, in a direction in which the engagement claw 33 engages the engagement stop hole 612.

Figure 8:
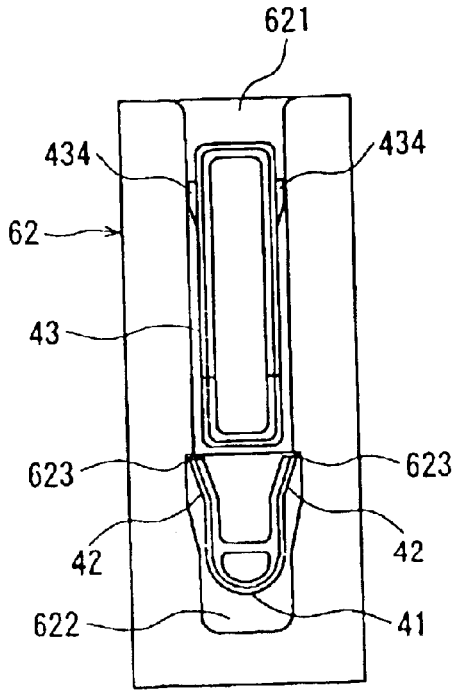
FIG. 8 is an explanatory drawing showing a locking state of the second locking mechanism constituting the toner supply container shown in FIG. 2.

During the descent of the toner supply container 10, the pair of engagement claws 42, 42 constituting the second locking mechanism 40 elastically deform inwardly relative to each other, with their junction with the guided portion 41 as the fulcrum, while descending along the guide groove 621. When the toner supply container 10 arrives at the mounting position shown in FIG. 10, the guided portion 41 and the pair of engagement claws 42, 42 fit in the fitting groove 622 of the guide member 62. As a result, the elastically deformed engagement claws 42, 42 as a pair return to the original state as shown in FIG. 8, and engage stepped portions 623, 623 (engagement stop portions) formed at the junctions between the guide groove 621 and the fitting groove 622. Thus, the toner supply container 10 is restrained from moving upward, and brought into a locked state. In the state in which the toner supply container 10 arrives at the mounting position shown in FIG. 10, the guide/fulcrum member 43 is positioned in the guide groove 621. In the image forming machine of FIG. 1, it is preferred to mount the toner supply container 10 directly from above in a horizontal posture in view of the problem of contamination of the interior of the machine. This can be realized according to the present embodiment. For example, a construction relying on a conical shaft and a simple hole may be considered in place of the construction shown in FIGS. 5 to 8. In this case, however, the toner supply container 10 has to be tilted. Furthermore, as in the construction of the present embodiment, the toner supply container 10 can be mounted on the machine body frame (an integrally molded resin frame) to achieve a space saving. In addition, the shapes of the receiving side (machine body) and the fitting side (toner supply container 10) may be reversed.

Next, an operation for withdrawing the toner supply container 10 from the mounting state shown in FIGS. 9 and 10 will be described.

Figure 9:
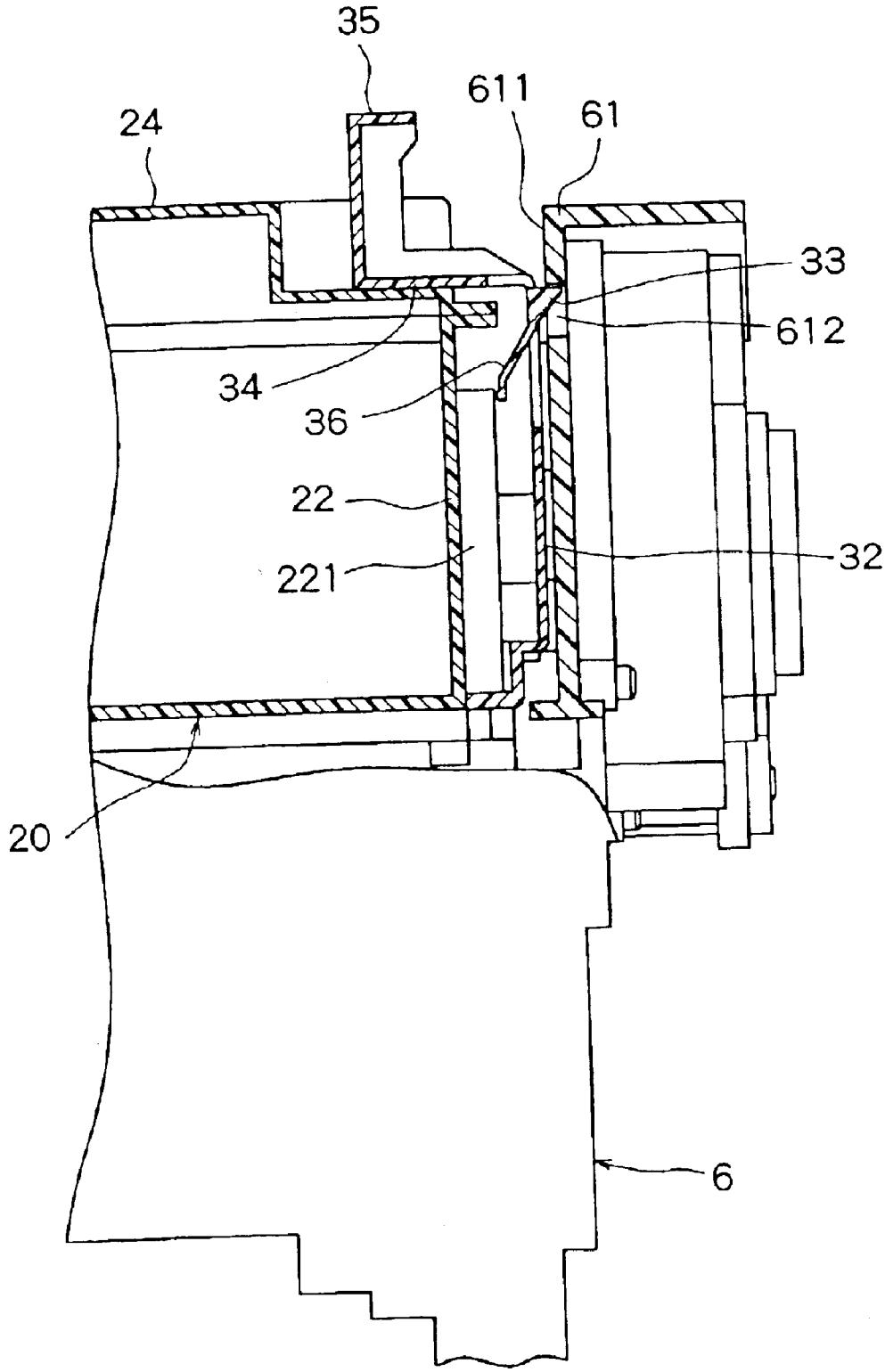
FIG. 9 is a sectional view of essential parts showing a locking state of the first locking mechanism, illustrating a state in which the toner supply container shown in FIG. 2 is mounted in a developing device of the image forming machine.
Figure 10:
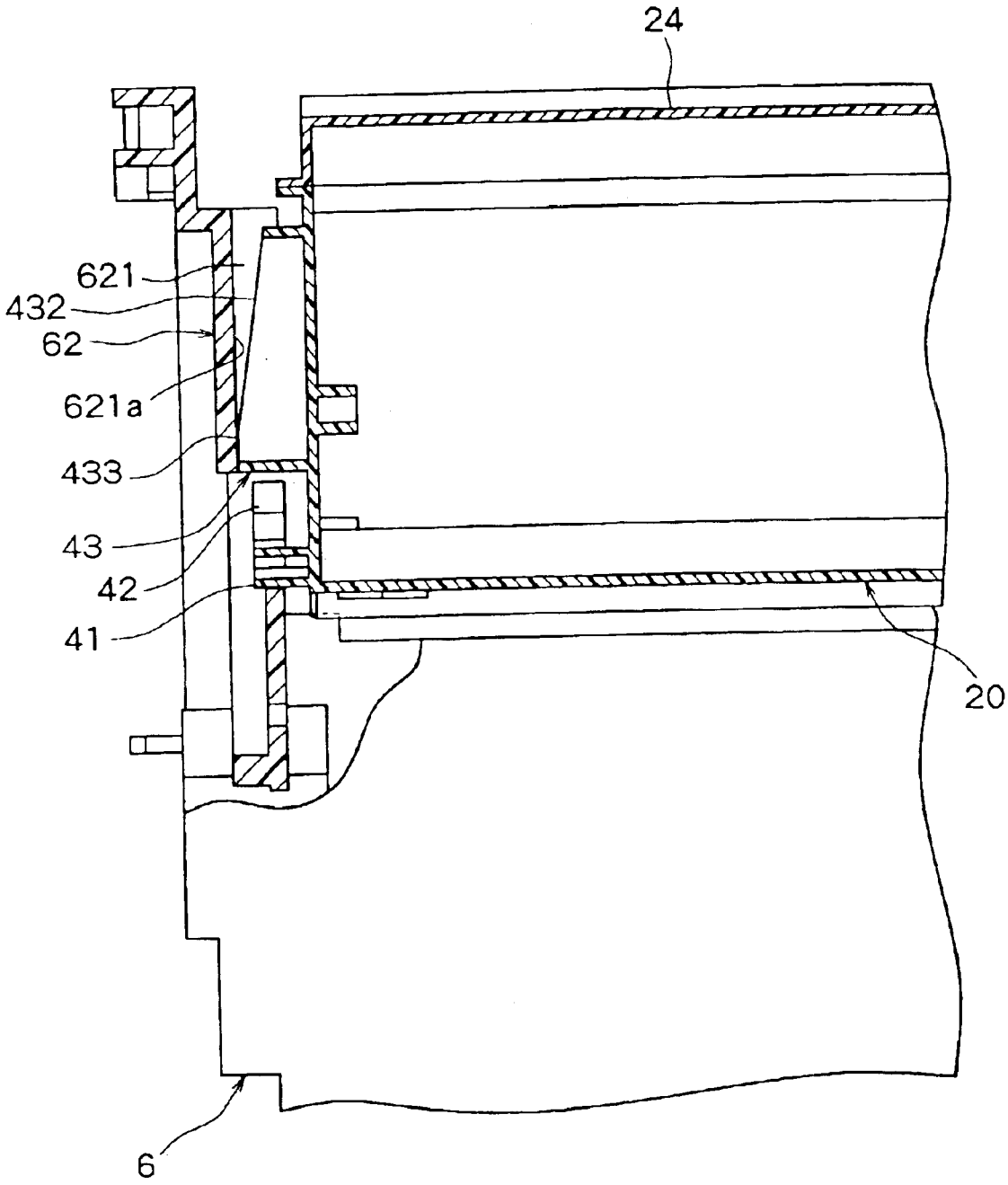
FIG. 10 is a sectional view of the essential parts showing a locking state of the second locking mechanism, illustrating a state in which the toner supply container shown in FIG. 2 is mounted in the developing device of the image forming machine.
Figure 11:
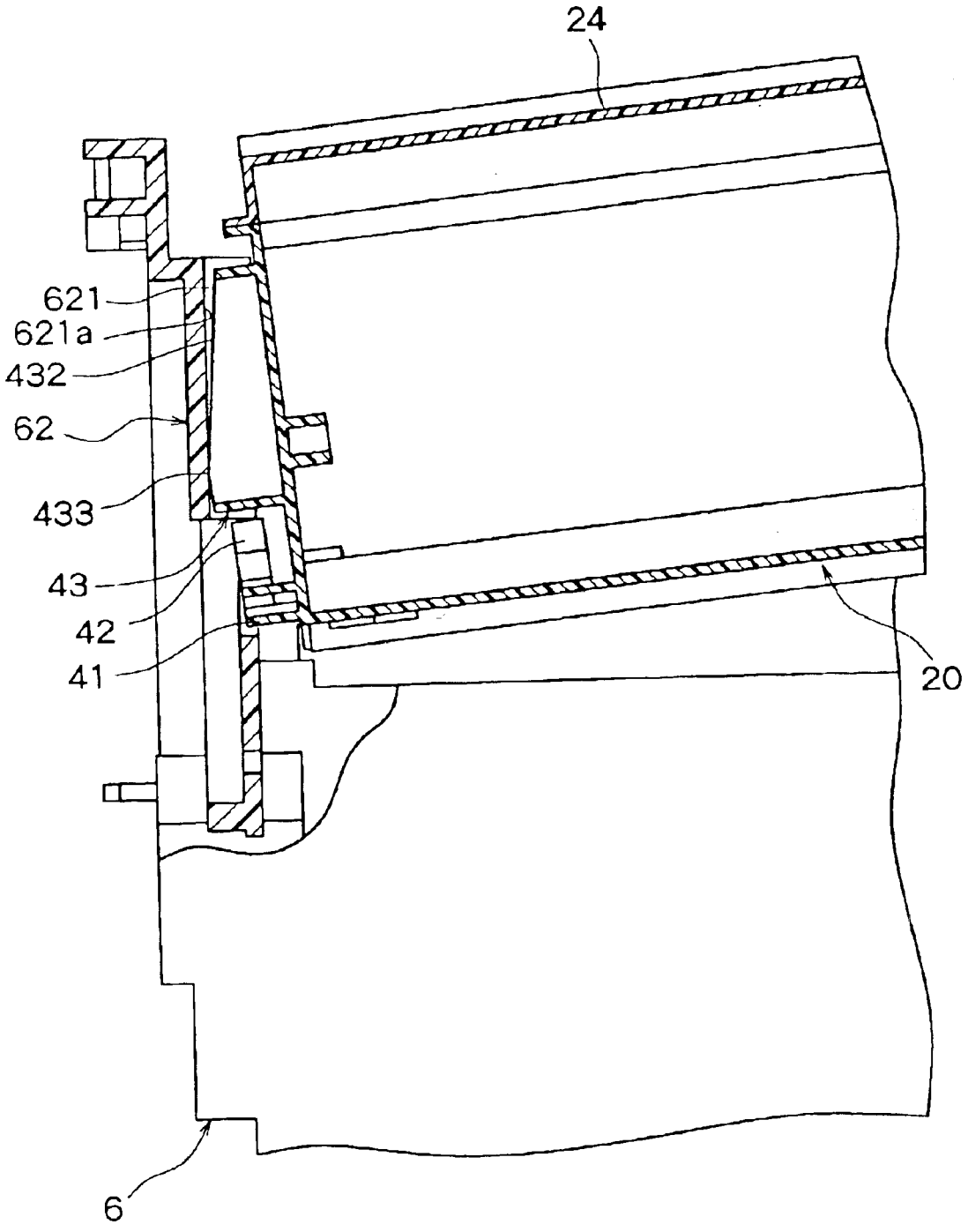
FIG. 11 is a sectional view of the essential parts showing a process in which the toner supply container shown in FIG. 2 is withdrawn from the developing device of the image forming machine.

To withdraw the toner supply container 10, the first step is to pull the grip 35, provided in the front end portion of the unlocking lever 34 of the first locking mechanism 30, leftward from the locked state shown in FIG. 9. As a result, the upper end portion of the support leg 32 connected to the unlocking lever 34 is elastically deformed leftward, with the lower end junction as the fulcrum, against the spring force of the spring portion 36. The engagement claw 33 provided in the upper end portion of the support leg 32 disengages from the engagement stop hole 612 formed in the first guide member 61, releasing itself from the locked state. In this unlocked stated, one end portion of the toner supply container 10 is brought upward. As a result, the toner supply container 10 swings counterclockwise about the other end portion thereof as a fulcrum, as shown in FIG. 11, whereby the guided portion 41 and the pair of engagement claws 42, 42 constituting the second locking mechanism 40 fitted into the fitting groove 622 of the second guide member 62 disengage from the fitting groove 622, releasing the locked stated. If a spring member is disposed in the machine body below the one end portion of the toner supply container 10 when mounted in the machine body, a mere leftward pull of the unlocking lever 34 from the locked state shown in FIG. 9 causes the one end portion of the toner supply container 10 to be pushed up by the spring force of the spring member, so that the locked state can be released.

In the illustrated embodiment, the guide/fulcrum member 43 is provided above the pair of engagement claws 42, 42 constituting the second locking mechanism 40. While the one end portion of the toner supply container 10 is being lifted, the junction 433 between the lower end portion 431 and the inclined surface 432 of the guide/fulcrum member 43 contacts a bottom surface 621*a* of the guide groove 621 formed in the second guide member 62, serving as the fulcrum for the aforementioned swinging of the toner supply container 10. This facilitates the operation for unlocking of the guided portion 41 and the pair of engagement claws 42, 42 from the fitting groove 622 by the swing of the toner supply container 10. The swing of the toner supply container 10, with the junction 433 between the lower end portion 431 and the inclined surface 432 of the guide/fulcrum member 43 being the fulcrum, is performed until the inclined surface 432 contacts the bottom surface 621*a* of the guide groove 621. After the locking by the second locking mechanism 40 is released in this manner, the one end portion of the toner supply container 10 is lifted as such, whereby the toner supply container 10 can be withdrawn from the housing 60 of the developing device 6, namely, the machine body.

The toner supply container according to the present invention is constructed as described above. When it is mounted, therefore, it can be locked by the first locking mechanism disposed in the one end portion of the container body and the second locking mechanism disposed in the other end portion of the container body. Thus, the locking takes place reliably. Moreover, when the toner supply container is withdrawn, the locked state by the first locking mechanism provided in the one end portion is released, and the one end portion of the toner supply container is lifted to tilt the toner supply container, whereby the locked state by the second locking mechanism can be released. This makes the operation extremely easy. Furthermore, the second locking mechanism lacks a positive unlocking mechanism. Thus, it is simple in structure, and can be constructed compactly.

What I claim is:

1. A toner supply apparatus of an image forming machine, comprising a container body accommodating toner, said container body being detachably mounted from above into a machine body of said image forming machine along a first guide member and a second guide member provided with a predetermined spacing in said machine body, said toner supply apparatus including:

a first locking mechanism disposed in one end portion of said container body and a second locking mechanism disposed in other end portion of said container body, and wherein said first locking mechanism includes a guided surface to be guided in an up-down direction along said first guide member, an engagement claw to be engaged with an engagement stop portion provided in said first guide member when said container body is located at a mounting position, and an unlocking lever for releasing engagement between said engagement claw and said engagement stop portion, and said second locking mechanism includes engagement claws, which are provided in a laterally protruding manner at a lower portion of a side surface of an end wall closing the other end of the container body and slidably along a guide groove formed in an up-down direction in said second guide member, engage engagement stop portions provided in said second guide member when said container body is lowered along said first guide member and said second guide member to be located at the mounting position, and the engagement between said engagement claws and said engagement stop portions is released when the one end portion of said container body is brought upward to tilt said container body.

2. The toner supply apparatus of an image forming machine as claimed in claim 1, wherein said second guide member has a fitting groove formed so as to be continuous with a lower end of said guide groove, said second locking mechanism has a guided portion provided on a lower side of said engagement claws and slidable along said guide groove, and said guided portion and said engagement claws are fitted into said fitting groove.

3. The toner supply apparatus of an image forming machine as claimed in claim 2, wherein said engagement claws of said second locking mechanism comprises a pair of engagement claws extending upwardly from both sides of the upper end of said guided portion in a fanning manner.

4. A toner supply apparatus of an image forming machine, comprising a container body accommodating toner, said container body being detachably mounted from above into a machine body of said image forming machine along a first guide member and a second guide member provided with a predetermined spacing in said machine body, said toner supply apparatus including:

a first locking mechanism disposed in one end portion of said container body and a second locking mechanism disposed in other end portion of said container body, and wherein said first locking mechanism includes an engagement claw to be engaged with an engagement stop portion provided in said first guide member when said container body is located at a mounting position, and an unlocking lever for releasing engagement between said engagement claw and said engagement stop portion, and said second locking mechanism includes engagement claws, which are provided in a laterally protruding manner at a lower portion of a side surface of the end wall closing the other end of said container body, engage engagement stop portions provided in said second guide member when said container body is located at the mounting position, and a fulcrum member that is disposed above said engagement claws in the side surface of said end wall and had an inclined surface tilting from a lower end portion toward an upper end, said engagement claws engaging engagement stop portions provided in said second guide member when said container body is located at the mounting position, and whose engagement with the engagement stop portions being released and said inclined surface coming into contact with said second guide member when the one end portion of said container body is brought upward, so that said container body is turned on a lower end portion of said fulcrum member as a fulcrum to be tilted.

5. The toner supply apparatus of an image forming machine as claimed in claim 4, wherein the lower end portion of said fulcrum member has an amount of protrusion larger than that of said engagement claws.

6. The toner supply apparatus of an image forming machine as claimed in claim 4, wherein said second guide member has a guide groove formed in an up-down direction and a fitting groove formed so as to be continuous with a lower end of said guide groove, said second locking mechanism has a guided portion provided on a lower side of said engagement claws and slidable along said guide groove, and said guided portion and said engagement claws are fitted into said fitting groove.

7. The toner supply apparatus of an image forming machine as claimed in claim 4, wherein said engagement claws of said second locking mechanism comprises a pair of engagement claws extending upwardly from both sides of the upper end of said guided portion in a fanning manner.

* * * * *